US009650230B2

(12) United States Patent
Ketonen

(10) Patent No.: US 9,650,230 B2
(45) Date of Patent: May 16, 2017

(54) INSULATED LANDING DOOR OF AN ELEVATOR

(71) Applicant: Ari Ketonen, Helsinki (FI)

(72) Inventor: Ari Ketonen, Helsinki (FI)

(73) Assignee: Kone Corporation, Helsinki (FI)

( * ) Notice: Subject to any disclaimer, the term of this patent is extended or adjusted under 35 U.S.C. 154(b) by 182 days.

(21) Appl. No.: 14/273,729

(22) Filed: May 9, 2014

(65) Prior Publication Data

US 2014/0246276 A1 Sep. 4, 2014

Related U.S. Application Data

(63) Continuation of application No. PCT/FI2012/051205, filed on Dec. 4, 2012.

(30) Foreign Application Priority Data

Dec. 13, 2011 (FI) ..... 20116266

(51) Int. Cl.

| | |
|---|---|
| ***B66B 13/30*** | (2006.01) |
| ***B66B 13/06*** | (2006.01) |
| *E06B 3/58* | (2006.01) |
| *E06B 3/72* | (2006.01) |
| *E06B 3/82* | (2006.01) |

(52) U.S. Cl.

CPC ..... *B66B 13/303* (2013.01); *B66B 13/06* (2013.01); *B66B 13/30* (2013.01); *E06B 3/5892* (2013.01); *E06B 3/72* (2013.01); *E06B 3/82* (2013.01)

(58) Field of Classification Search

CPC ..... B66B 13/303; B66B 13/06; B66B 13/30; E06B 3/5892; E06B 3/72; E06B 3/82

USPC ..... 187/336

See application file for complete search history.

(56) References Cited

U.S. PATENT DOCUMENTS 3,340,962 A * 9/1967 Link ..... B66B 13/303 187/325

5,139,111 A * 8/1992 Baumann ..... B66B 13/303 187/333

(Continued)

FOREIGN PATENT DOCUMENTS

CN 1322669 A 11/2001

DE 2006159 A1 8/1971

(Continued)

OTHER PUBLICATIONS

Chinese Office Action issued Jan. 26, 2016, in Chinese Patent Application No. 201280061074.5.

(Continued)

*Primary Examiner* — Michael Riegelman

(74) *Attorney, Agent, or Firm* — Harness, Dickey & Pierce, P.L.C.

(57) ABSTRACT

The object of the invention is an insulated landing door of an elevator, which door comprises at least one door panel that opens and closes in the lateral direction and is provided with a glass surface plate, which door panel comprises a frame structure supporting the door panel and an edge beading on the front edge of the door panel and an insulation element. The insulation element is composed of one or more glass plates, and that there is an air gap between the glass surface plate and the glass insulation element.

12 Claims, 4 Drawing Sheets

(56) References Cited

U.S. PATENT DOCUMENTS

Figure 1:
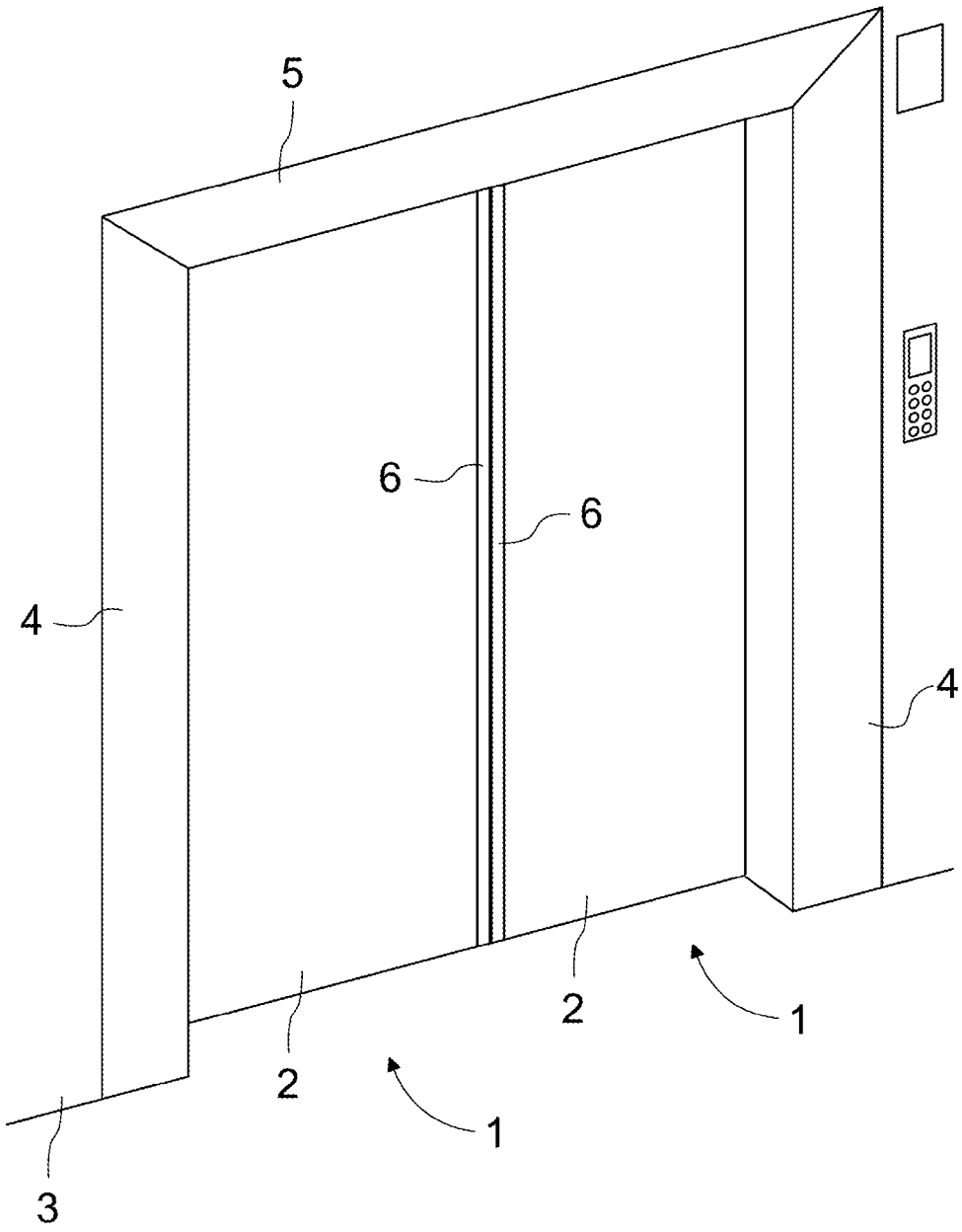

| | | | | |
|---|---|---|---|---|
| 5,794,746 | A * | 8/1998 | Ketonen | B66B 13/301 187/333 |
| 6,540,048 | B1 * | 4/2003 | Muller | B66B 13/303 187/325 |
| 6,589,613 | B1 * | 7/2003 | Kunert | E06B 3/6715 428/34 |
| 7,834,265 | B2 * | 11/2010 | Schmidt | H01L 31/02008 136/251 |
| 7,887,921 | B2 * | 2/2011 | Varanasi | A47F 3/0434 428/432 |

FOREIGN PATENT DOCUMENTS

| | | | |
|---|---|---|---|
| EP | 2239223 | A1 | 10/2010 |
| FR | 2672081 | A1 | 7/1992 |
| GB | 667150 | A | 2/1952 |
| GB | 1470996 | A | 4/1977 |
| JP | 2002167146 | A | 6/2002 |
| JP | 2008105800 | A | 5/2008 |
| WO | WO-2008002237 | A1 | 1/2008 |

OTHER PUBLICATIONS

Extended European Search Report issued Jun. 30, 2015, in European Patent Application No. 12857975.2.
Chinese Office Action issued Apr. 14, 2015, issued in Chinese Patent Application No. 201280061074.5.
International Search Report PCT/ISA/210 for Internation Application No. PCT/FI2012/051205 dated Dec. 4, 2012.
Written Opinion PCT/ISA/237 for Internation Application No. PCT/FI2012/051205 dated Dec. 4, 2012.
Finnish Search Report issued by Patent Office in Finland dated Oct. 3, 2012.

* cited by examiner

INSULATED LANDING DOOR OF AN ELEVATOR

This application is a continuation of PCT International Application No. PCT/FI2012/051205 which has an International filing date of Dec. 4, 2012, and which claims priority to Finnish patent application number 20116266 filed Dec. 13, 2011, the entire contents of both which are incorporated herein by reference.

The object of the invention is an insulated landing door of an elevator.

In the doorways of the floor levels of the elevator hoistways of, in particular, public premises, such as metro stations and shopping malls, as well as of other buildings, insulated fire doors are used to prevent the access of thermal radiation, fire and also combustion gases during a fire into the elevator car and via the elevator hoistway from one floor to another. A landing door can be either just thermally insulated or also fire insulated. The insulation has different requirements in different premises and in different countries.

One method according to prior art is to dispose on each floor level a separate fire door provided with the necessary insulation in addition to the actual landing door of the elevator. A problem in these solutions is that the fire door is a fully separate structure with respect to the landing door of the elevator, in which case it takes up a lot of expensive building space in the thickness direction of the doors and, as an extra structure, is expensive and also causes extra servicing costs and maintenance costs.

According to prior art fire door solutions for an elevator are also known in which the landing door of an elevator and an insulated, generally metal, fire door are combined to operate as one door. These solutions are generally, however, also very thick and, in addition, heavy. A problem in these solutions also is the large space needed in the thickness direction of the doors of the elevator as well as the durable support structures and machines needed owing to the massive structure.

Additionally, one problem of the solutions according to prior art describe above is that they are not necessarily aesthetically suitable for public premises and there is no visual contact from the elevator car to the outside world, which visual contact creates in elevator passengers a feeling of security and also prevents malicious damage possibly occurring inside the elevator car, such as e.g. vandalism of the inside walls of the elevator car and of objects inside the elevator car.

The aim of the present invention is to eliminate the aforementioned drawbacks and to achieve an inexpensive and functional landing door of an elevator, said door being durable in use and either fully or partly transparent, which is at the same time one of the following: a sound insulated, thermally insulated or fire insulated door or a flame containment door. The invention also aims for the type of structures with which an elevator landing door appropriate to its given operating environment can be realized functionally and aesthetically.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts.

Likewise the different details presented in connection with each embodiment can also be applied in other embodiments. In addition it can be stated that at least some of the subordinate claims can in at least some situations be deemed to be inventive in their own right.

One advantage, among others, of the solution according to the invention is that an aesthetically suitable and operationally safe glass door solution can be realized as an insulated fire door of the elevator hoistway, in which case a lot of other advantages are obtained. One advantage, among others, is that a glass door can be seen through, both from the elevator car outwards and also inwards into the elevator car. In this case the feeling of safety of the occupants of the elevator car improves. In addition, transparency reduces deliberate disfiguration of the inside of the elevator car.

By the aid of the invention, a door structure that enables a fairly narrow door frame can be achieved. The invention enables a transparent landing door of an elevator, which door is operationally safe and aesthetically appropriate for its given operating environment.

Preferably the door of the invention is a fire insulated door, which adequately prevents the access of thermal radiation, fire and combustion gases into the elevator car and via the elevator hoistway to other floors.

Owing to an insulating nature of the structure, a landing door that prevents frosting of the glass structures of the landing door can easily be obtained.

By means of the invention a structure having only an insignificant raised edge, or no raised edge at all, towards the plane of the door between the frame and the glass surface can be achieved. This enhances operating safety. In other words, with the invention an advantage is achieved in that the outer surface of the landing door provided with glass according to the invention is essentially smooth and flat, in which case there is no dangerous raised edge between the glass surface and the door frame that might injure e.g. the fingers of people, and particularly of children, when the door moves. With the invention a raised edge towards the plane of at most 1 mm is fairly easily achieved between the glass and the frame surrounding it, and even a difference of at most 0.4 mm (+/−) between the glass and the plane of the frame is not difficult. In practice an absolutely smooth surface of the door on the landing side can be achieved if the thickness tolerances of the components of the structure are sufficiently good.

In a preferred embodiment of the invention the landing door of an elevator comprises at least one door panel that opens and closes in the lateral direction and is provided with a glass surface plate, which door panel comprises a frame structure supporting the door panel and an edge beading on the front edge of the door panel and an insulation element. The insulation element is composed of one glass plate or a stack of glass plates. In this preferred embodiment of the invention there is an air gap between the glass surface plate and the glass insulation element. Preferably the glass plates of the insulation element are laminated to each other. Instead of the insulation element being based on layers of glass plate, it can have in addition to one or more layers of glass plate also one or more layers of a different type, e.g. a plastic material layer or air gap appropriate for fire insulation use. One method easy to fabricate is to make the surface glass, i.e. the glass surface plate, to be single layer. The surface glass can, within the scope of the invention, comprise two or more layers. Such layers can also be of different sizes in their surface area such that the inner layer of the structure is larger.

One preferred solution for implementing the invention is of the type wherein an insert is between the insulation element and the surface glass for making an air gap between them. The outer surface of the surface glass and the edge beading towards the plane of the door are configured to be on essentially the same plane, preferably by dimensioning and, if necessary, by configuring the thickness of the insert and of the surface glass suitably with each other. Essentially on the same plane in this context means that any raised edge between the edges of the surface glass and of the edge beading that are facing each other is not very large, preferably no larger than 1 mm (+−). Apart from the selection of the thicknesses with regard to each other of the surface plate and the surface glass, also the compressible edge seal, or corresponding, stacked with the surface glass and the insert can be used for such configuring.

By varying the door structure the insulation properties can be configured for the needs and requirements at the time. If only thermal insulation capability is needed, e.g. to prevent misting, the insulation element does not need to be a fire protection element. When using a door for fire insulation purposes, e.g. the insulation element in the structure can be varied. For example, a fire insulation requirement of 60 minutes results in a different type of insulating element than if the fire insulation requirement were 30 minutes. Likewise there may be a need to improve the fire insulation properties of the frame structure, e.g. by adding or changing materials.

Yet another advantage is that, compared to massive, thick fire doors and separate fire door solutions, the door according to the invention is, as a single glass structure, a lot thinner in the thickness direction of the elevator doors than solutions according to prior art and therefore takes up a lot less expensive floor space. Another advantage is that the air gap enables flexing of the surface glass in the direction of the elevator car without the surface glass touching the glass insulation element or at least reduces an impact directed at the glass insulation element via the surface glass. This improves the durability of the door structure. Another advantage is that the masses to be moved are smaller, in which case the door solution is safer and the machines needed are smaller and cheaper. In addition, the light door solution according to the invention is easy to move, in which case the doors can be made to operate quickly, which improves capacity and also the service capability of the elevator. Likewise installation of the landing door is easier than that of solutions known in the art.

Figure 2:
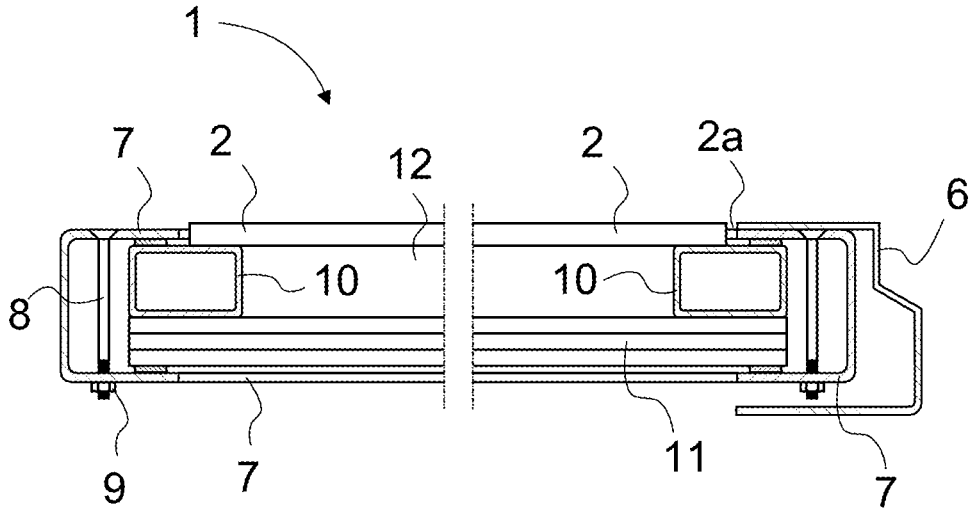
Figure 3:
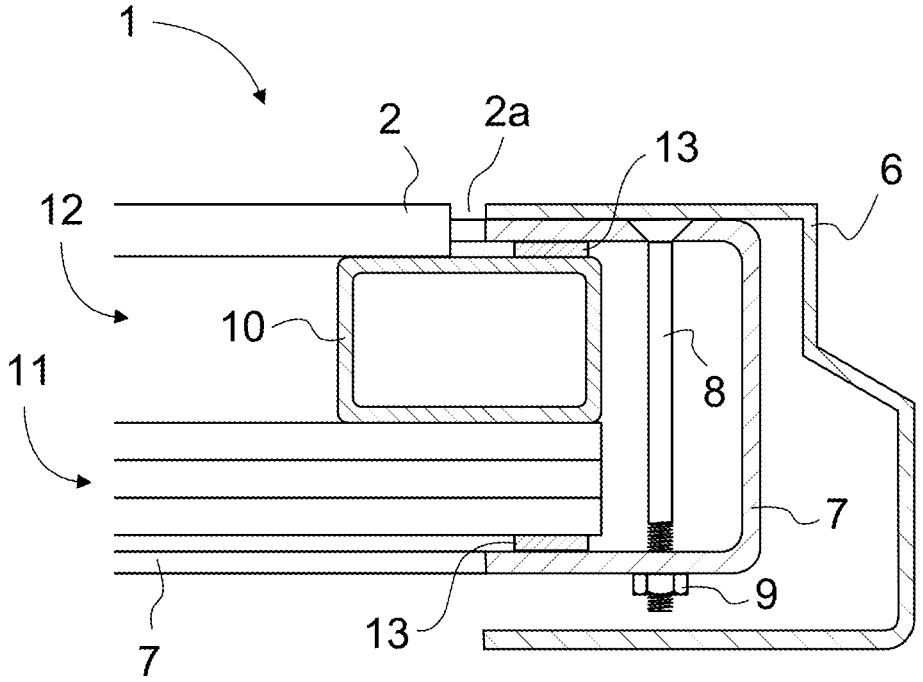
Figure 4:
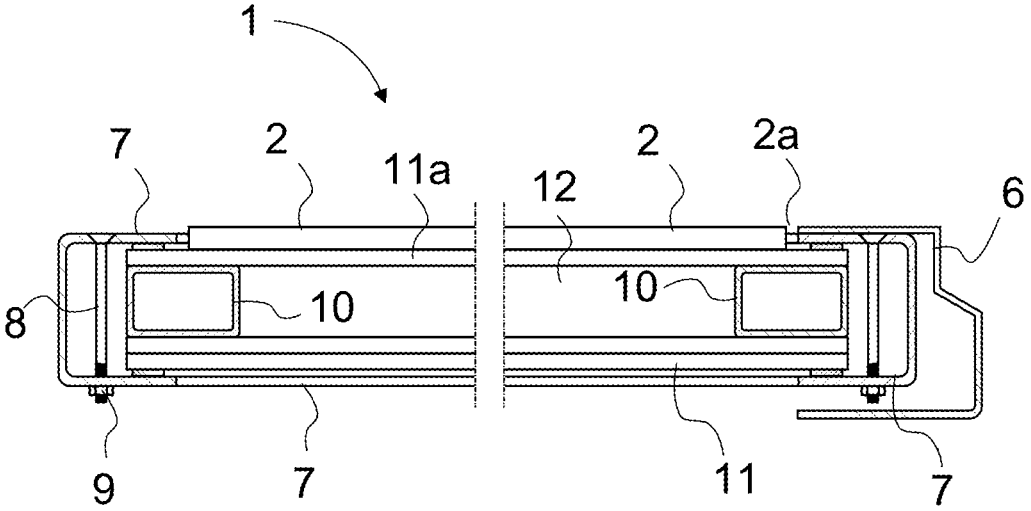
Figure 5:
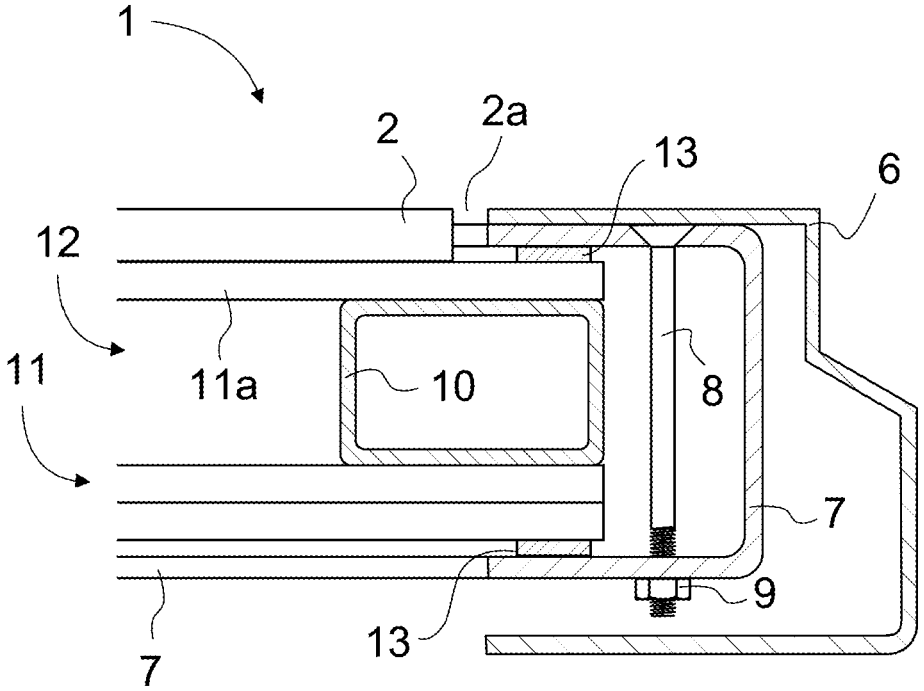
Figure 6:
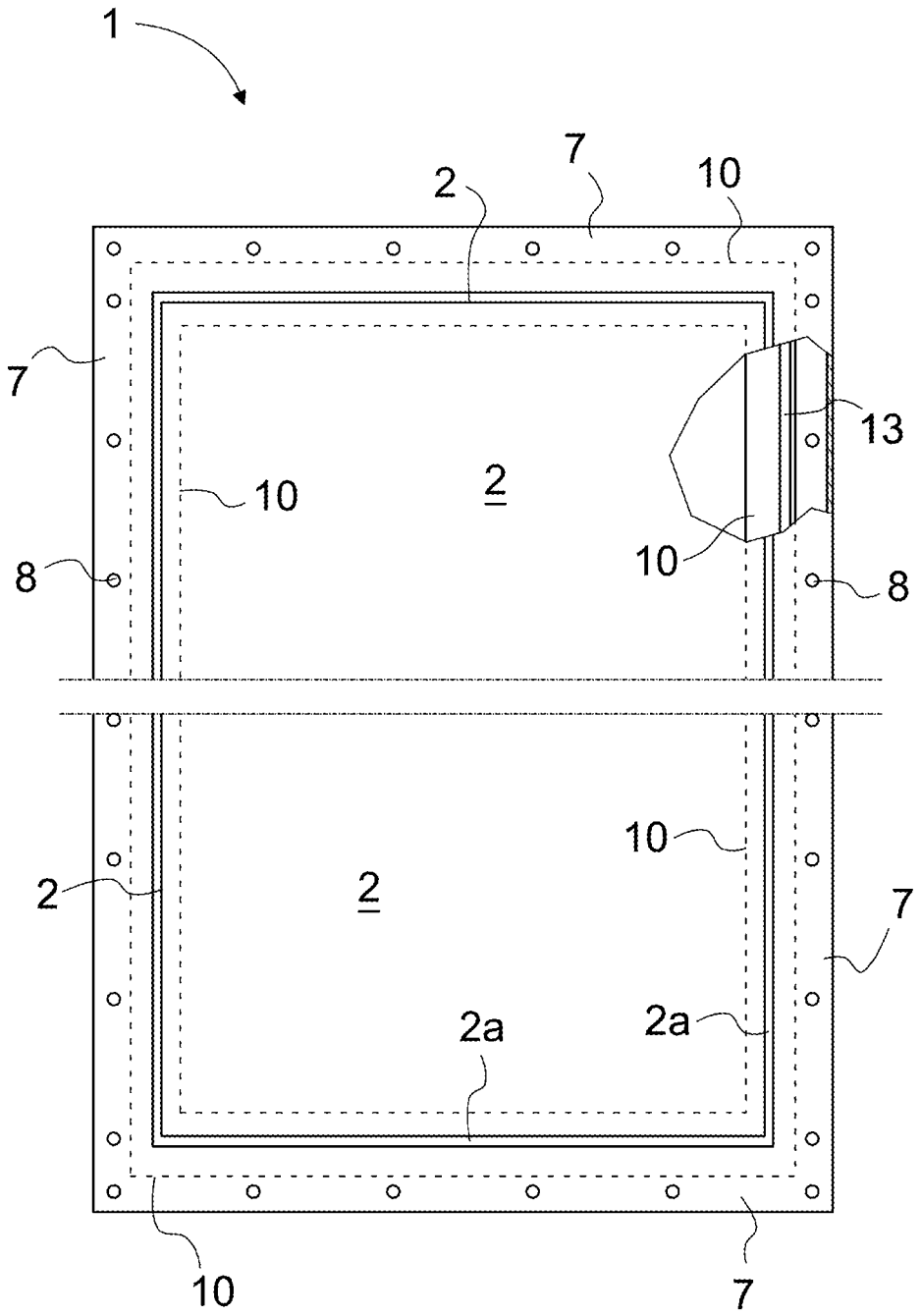

In the following the invention will be described in more detail by the aid of some examples of its embodiment with reference to the attached simplified drawings, wherein FIG. 1 presents an oblique top view from the front of one landing door of an elevator at the floor level, FIG. 2 presents a simplified and sectioned top view of one preferred structure of a landing door of an elevator, FIG. 3 presents a simplified, sectioned and magnified view of an edge structure of the landing door of an elevator according to FIG. 2, FIG. 4 presents a simplified and sectioned top view of one second preferred structure of a landing door of an elevator, FIG. 5 presents a simplified, sectioned and magnified view of an edge structure of the landing door of an elevator according to FIG. 4, and FIG. 6 presents a simplified and partially sectioned front view of a structure of a landing door of an elevator.

The insulated landing door of an elevator according to FIG. 1 comprises two door panels 1 moving reciprocally on their own plane, which door panels are provided on their outer surface on the floor level side with surface glass 2 of almost the size of the door panel 1. The front edge of each door panel 1 comprises edge beading 6 of essentially the height of the door panel 1, which beading is configured to overlap with the edge beading 6 of the door panel moving in the opposite direction. The doorway is edged e.g. with a metallic cover plate 4 on the sides of the doorway and with a metallic cover plate 5 on the top edge of the doorway such that the doorway blends into the wall 3 of the floor level in the desired manner.

FIGS. 2 and 3 present simplified and sectioned views of one structure of a door panel 1 of a landing door of an elevator according to the invention, as viewed from above. The door panel 1 comprises at least a frame structure 7, surface glass 2, an insert 10, an air gap 12 and also an insulation element 11 of laminated glass, which functions as fire glass. The air gap 12 functions as a noise break and thermal break, and thus for its part improves the insulation properties of the door structure. The frame structure 7 is composed of at least e.g. beams essentially U-shaped in their cross-sectional shape, which are configured to form an unbroken, ring-like frame structure, which passes around the whole door panel 1 at the top, the sides and the bottom. The edge beading 6 on the front edge of the door panel 1 is fixed to one vertical beam of the frame structure 7 such that the edge beading 6 covers the vertical beam inside it.

On the inside surface of the door panel 1 an insulation element 11 is fitted inside the frame structure 7, which insulation element is composed of e.g. one or more glass plates. When there are more glass plates than one, e.g. two, three or four, the glass plates one above the other are laminated to each other into a single laminated glass stack. Between the insulation element 11 and the surface glass 2 is an air gap 12, in which is air or another suitable gas. There can also be overpressure or underpressure in the air gap 12. The air gap 12 is formed by the aid of an insert 10, which is e.g. a ring-like structure, which passes around the inside of the frame structure 7 at the top part, sides and bottom part of the door panel 1. The insert 10 comprises e.g. a thin-walled rectangular tube or solid structure, having a thickness allowing the magnitude of the air gap 12 to be that desired. The insert 10 is fixed at one of its side surfaces e.g. with glue to the outer surface of the insulation element 11 and further at another of its side surfaces e.g. with glue to the inside surface of the surface glass 2. In this description, the outer surface means the surface on the side of the floor level and the inside surface means the surface on the side of the elevator car. The insulation element 11 and the insert 10 are additionally pressed against each other by the aid of tightening means 8 and 9, such as screws and nuts, and also by the aid of the frame structure 7.

FIG. 3 presents a magnification of the structure of the door panel 1 according to the invention. Inside the frame structure 7 are seals 13 passing around the frame structure 7, the purpose of which seals is to prevent the access of thermal radiation, fire and combustion gases from a floor level into the elevator car and via the elevator hoistway to other floors. The seal 13 is between the outer surface of the insert 10 on the floor level side and the inside surface of the frame structure 7 and correspondingly on the elevator car side between the elevator car side surface of the insulation element 11 and the inside surface of the frame structure 7. The seal 13 is fixed into its position e.g. with glue and/or with compression by the aid of tightening means 8 and 9. When tightening the tightening means 8 and 9, the side flanges of the frame structure 7 bend towards each other pressing the seal 13, the insert 10 and the glass insulation element 11 firmly against each other inside the frame structure 7. The seal 13 is to some extent compressible. By utilizing the compressibility of the seal and the possibility of compressing the structure with tightening means, the thickness of the structure can be configured such that the surfaces towards the plane of the edge beading 6 and of the surface glass 2 of the landing door are essentially, or even precisely, on the same plane. The landing door of an elevator according to the invention is, depending on its intended use, either just thermally insulated or also fire insulated and additionally also noise insulated.

The thickness of the air gap 12 and at the same time of the insert 10 and the thickness of the surface glass 2 are dimensioned and configured between themselves to be such that when the surface glass 2 is in its position on the door panel 1, the outer surface of the door panel 1 forms a uniform plane with no protruding raised edge, which might when the door panel 1 moves engage with something and injure e.g. children's fingers. In this case the outer surface of the door panel 1 is essentially smooth and the outer surface of the surface glass 2 of the door panel 1 and the outer surface of the edge beading 6 move on the same vertical plane.

Between the side edge of the surface glass 2 on the side of the edge beading 6 and the inside edge of both the edge beading 6 and the frame structure 7 is an essentially vertical gap 2*a*, which in the finished door is preferably filled with some filler, such as silicone compound or with some corresponding compound. The filler is not presented in FIG. 3.

FIGS. 4 and 5 present simplified and sectioned views of one second structure of a door panel 1 of a landing door of an elevator according to the invention, as viewed from above. In this structure the door panel 1 comprises at least a frame structure 7, surface glass 2, an insert 10, an air gap 12 and also a laminated insulation element 11, which comprises extra insulation glass 11*a*. The frame structure 7, surface glass 2, insert 10 and air gap 12 with filler are essentially the same as in the structure according to FIGS. 2 and 3, but the glass insulation element 11 is different. It is composed of a glass stack on the elevator car side, said stack being comprised of one or more essentially similar glass plates, like the structure according to FIGS. 2 and 3, but the insulation element 11 is divided with an air gap 12 into two parts, wherein on the second side, i.e. on the floor level side, of the air gap 12 is extra insulation glass 11*a*, which is glued attached at its inside surface to the outer surface of the insert 10. Correspondingly, the surface glass 2 is glued attached at its inside surface to the outer surface of the extra insulation glass 11*a*.

The glass insulation element 11, the extra insulation glass 11*a* and the insert 10 are pressed against each other by the aid of tightening means 8 and 9, such as screws and nuts, and also by the aid of the frame structure 7 in the same way as in the structure according to FIGS. 2 and 3.

FIG. 5 presents a magnified view of the structure of the open door panel 1 of FIG. 4. In this solution also inside the frame structure 7 are seals 13 passing around the frame structure 7, the purpose of which seals is to prevent the access of thermal radiation, fire and combustion gases from a floor level into the elevator car and via the elevator hoistway to other floors. The seal 13 is between the outer surface of the extra insulation glass 11*a* on the floor level side and the inside surface of the frame structure 7 and correspondingly on the elevator car side between the elevator car side surface of the glass insulation element 11 and the inside surface of the frame structure 7. The seal 13 is fixed into its position e.g. with glue and/or with compression by means of tightening means 8 and 9. When tightening the tightening means 8 and 9, the side flanges of the frame structure 7 bend towards each other pressing the seal 13, the extra insulation glass 11*a*, the insert 10 and the insulation element 11 firmly against each other inside the frame structure 7.

The thickness of the air gap 12 and at the same time of the insert 10 and the thickness of the surface glass 2 are dimensioned and configured between themselves to be such that when the surface glass 2 is in its position on the door panel 1, the outer surface of the door panel 1 forms a uniform plane with no protruding raised edges. In this case the outer surface of the door panel 1 is essentially smooth and the outer surface of the surface glass 2 of the door panel 1 and the outer surface of the edge beading 6 move on the same vertical plane.

Between the side edge of the surface glass 2 on the side of the edge beading 6 and the inside edge of both the edge beading 6 and the frame structure 7 is an essentially vertical gap 2*a*, which in the finished door is preferably filled with some filler, such as silicone compound or with some corresponding compound. The filler is not presented in FIG. 5.

FIG. 6 presents a simplified and partially sectioned front view, truncated in the height direction, of the structure of one door panel 1 of a landing door of an elevator according to the invention. From FIG. 6 it is seen how the frame structure 7, insert 10 and seals pass around the top, sides and bottom of the whole door panel. For the sake of clarity, the insert 10 is presented as a dashed line except at the point of the partial cross-section. There are many tightening means 8 and 9 and in the necessary points in the area of essentially all the frame structure 7.

The landing door of an elevator according to the invention can, if necessary, be fabricated to be however insulating as is needed and to fulfill the fire insulation standards and other standards required for different applications in different countries.

It is obvious to the person skilled in the art that the invention is not limited solely to the examples described above, but that it may be varied within the scope of the claims presented below. Thus the insulation glass structures can also be different to what is presented above.

The invention claimed is:

1. A insulated landing door of an elevator, the insulating landing door comprising:

at least a first door panel configured to open and close in a lateral direction, the lateral direction perpendicular to a movement direction of the elevator, and the first door panel having a floor level side facing a floor and a hoistway side facing a hoistway, the first door panel including, a glass surface plate, a frame structure surrounding an edge the glass surface plate and supporting the first door panel, edge beading extending continuously along an edge of the first door panel from a top of the first door panel to a bottom of the first door panel, the edge beading being attached to the frame structure on the floor level side of the first door panel and wrapping around the edge of the first door panel such that the edge beading is configured to overlap with edge beading of a second door panel configured to move in a direction opposite to the first door panel, and a glass insulation element including at least one glass plate, the glass insulation element spaced apart from the glass surface plate by an air gap between the glass surface plate and the glass insulation element, the air gap defined by an insert between the glass insulation element and the glass surface plate, the glass insulation element and the insert being pressed against each other by a fastener and the frame structure.

2. The insulated landing door according to claim 1, wherein the edge beading wraps around the edge of the first door panel such that a surface of the edge beading and a surface of the glass surface plate lie on a same plane in the lateral direction, and, along the edge of the first door panel, the edge beading is divided into a first portion and a second portion each extending different lengths from the edge of the first door panel in the lateral direction such that the edge beading is configured to overlap with edge beading of a second door panel configured to move in a direction opposite to the first door panel.

3. The insulated landing door according to claim 1, wherein the glass insulation element includes a plurality of glass plates.

4. The insulated landing door according to claim 3, wherein the plurality of glass plates are laminated to each other.

5. The insulated landing door according to claim 1, wherein a thickness of the insert and a thickness of the glass surface plate are configured such that a surface of the glass surface plate and a surface of the edge beading are on a same plane on the floor level side of the first door panel.

6. The insulated landing door according to claim 1, wherein:

the insert has a ring structure;

a first side surface of the insert is fixed to a surface of the glass insulation element facing the floor level side of the first door panel; and a second side surface of the insert is fixed to a surface of the glass surface plate facing an elevator car side of the first door panel.

7. The insulated landing door according to claim 1, further comprising:

at least one other glass plate between an outer surface of the insert and an inside surface of the glass surface plate; wherein an outer surface of the glass insulation element is fixed to an inside surface of the insert, the outer surface of the insert faces the floor level side of the first door panel, the inside surface of the glass surface plate faces an elevator car side of the first door panel, the outer surface of the glass insulation element faces the floor level side of the first door panel, and the inside surface of the insert faces the elevator car side of the first door panel.

8. The insulated landing door according to claim 7, wherein the at least one other glass plate, the glass insulation element and the insert are pressed against each other by a fastener and the frame structure.

9. The insulated landing door according to claim 8, wherein the fastener is a combination of screws and nuts.

10. The insulated landing door according to claim 7, wherein the first door panel comprises:

at least a first seal between an outer surface of the at least one other glass plate and an inside surface of the frame structure, the outer surface of the at least one other glass plate facing the floor level side, and the inside surface of the frame structure facing the elevator car side; and at least a second seal between an inside surface of the frame structure and the outer surface of the glass insulation element, the inside surface of the frame structure facing the floor level side.

11. The insulated landing door according to claim 1, wherein the first door panel comprises:

at least a first seal between an outer surface of the insert and an inside surface of the frame structure, the outer surface of the insert facing the floor level side, and the inside surface of the frame structure facing an elevator car side of the first door panel; and at least a second seal between an inside surface of the frame structure and an outer surface of the glass insulation element, the inside surface of the frame structure facing the floor level side, and the outer surface of the glass insulation element facing the elevator car side.

12. The insulated landing door according to claim 1, wherein the fastener is a combination of screws and nuts.

* * * * *